US009327508B2

(12) United States Patent
Muhl et al.

(10) Patent No.: US 9,327,508 B2
(45) Date of Patent: May 3, 2016

(54) PRINTING APPARATUS

(71) Applicants: Wolfgang Muhl, Hohen Neuendorf (DE); Stefan Beckmann, Falkensee (DE)

(72) Inventors: Wolfgang Muhl, Hohen Neuendorf (DE); Stefan Beckmann, Falkensee (DE)

(73) Assignee: Francotyp-Postalia GmbH, Berlin (DE)

( * ) Notice: Subject to any disclaimer, the term of this patent is extended or adjusted under 35 U.S.C. 154(b) by 0 days.

(21) Appl. No.: 14/666,545

(22) Filed: Mar. 24, 2015

(65) Prior Publication Data

US 2015/0266301 A1 Sep. 24, 2015

(30) Foreign Application Priority Data

Mar. 24, 2014 (DE) ..... 10 2014 103 987

(51) Int. Cl.
*B41J 2/175* (2006.01)

(52) U.S. Cl.
CPC ..... *B41J 2/1752* (2013.01); *B41J 2/17503* (2013.01)

(58) Field of Classification Search
CPC .. B41J 2/1752; B41J 2/17513; B41J 2/17553; B41J 2/17523; B41J 2/17556
See application file for complete search history.

(56) References Cited

U.S. PATENT DOCUMENTS

| | | | | |
|---|---|---|---|---|
| 4,755,836 | A * | 7/1988 | Ta et al. | 347/49 |
| 5,917,518 | A * | 6/1999 | Ohashi et al. | 347/37 |
| 6,224,192 | B1 * | 5/2001 | Robinson | B41J 2/1752 347/49 |
| 6,412,911 | B1 | 7/2002 | Hilton et al. | |
| 6,623,189 | B2 | 9/2003 | Ansell et al. | |
| 7,536,701 | B2 * | 5/2009 | McCormack et al. | 720/657 |
| 7,959,276 | B2 | 6/2011 | Muhl | |
| 8,162,458 | B2 | 4/2012 | Muhl | |
| 8,262,178 | B2 | 9/2012 | Muhl | |
| 2006/0001707 | A1 | 1/2006 | Ito et al. | |
| 2010/0002049 | A1 | 1/2010 | Ueda et al. | |
| 2010/0007700 | A1 | 1/2010 | Muhl | |
| 2013/0335497 | A1 | 12/2013 | Ortmann et al. | |

FOREIGN PATENT DOCUMENTS

| | | | |
|---|---|---|---|
| EP | 0469536 | B1 | 5/1996 |
| EP | 0710568 | A2 | 5/1996 |
| EP | 1348562 | A2 | 10/2003 |
| WO | 03026894 | A1 | 4/2003 |

* cited by examiner

*Primary Examiner* — Julian Huffman
*Assistant Examiner* — Jeremy Delozier
(74) *Attorney, Agent, or Firm* — Schiff Hardin LLP

(57) ABSTRACT

A printing apparatus has a cartridge carrier and with a locking-and-ejection mechanism. The cartridge carrier has a cavity for insertion of an ink cartridge, and the locking-and-ejection mechanism is arranged on an outside of a side part of a cartridge carrier. This locking-and-ejection mechanism has a locking mechanism with a locking lever biased by a spring force produced by a first spring. The locking lever can be tilted around a rotation axis situated on the outside of the side part. The locking-and-ejection mechanism also has an ejection mechanism with a lifting plate biased by a spring force produced at least by a second spring. The lifting plate is rotatable on the outside of the side part, and the rotation axis of the lifting plate is stationary on the outside of the side part. The locking lever has a first locking mechanism and a second locking mechanism to the lock the first locking mechanism, and an actuator is operable to unlock the locking of the second locking mechanism. The lifting plate is rotatable by a sufficient amount that the locking lever is held in the unlocked position after an ejection of an ink cartridge.

10 Claims, 10 Drawing Sheets

PRINTING APPARATUS

BACKGROUND OF THE INVENTION

1. Field of the Invention

The invention concerns a printing apparatus of the type having an inkjet printing device with an ink cartridge plugged into a cartridge carrier, and a control unit that controls the printing. The cartridge carrier is mounted on a sled that is moved back and forth during the printing. The sled can be controlled into a predetermined position to exchange the ink cartridge. The inserted ink cartridge is locked and can be unlocked and ejected via a mechanism installed on the side of the cartridge carrier. The printing apparatus is suitable for 1-inch receipt printers and is used in franking and addressing machines, and in other printing mail processing apparatuses.

2. Description of the Prior Art

An arrangement for exchanging ink cartridges is known from German Patent Application DE 102007060733 A1. This printing apparatus has a transport device for flat goods, a contact pressure device and a printing module, wherein the transport device is stationary in the printing device relative to a contact pressure device that presses the mail piece onto a transport belt of the transport device. The transport belt acts in the transport region with a predetermined stiction on a portion of the surface of the mail piece that has not been inprinted but is situated near to the region to be printed. An exchange position for ink cartridges is located before the transport region, on the front side of the printing device, or above the transport region of the transport device, which is designed to allow such exchange.

The printing module has a print carriage with two compartments for insertion of ink cartridges. Upon insertion, the ink cartridges have a bulge directed forward that includes an ink reservoir. The print carriage of the printing module has a respective opening for insertion of the ink cartridges, which opening is limited laterally by a right-side plate and left-side plate and at the floor by a shaped carrier part, as well as to the rear by a contact panel of the contacting and control electronics. The shaped carrier part is comprised of two halves that are offset relative to one another. A locking lever is attached to the right-side plate and left-side plate so as to be rotatable. The print head of each of the ink cartridges that are arranged offset relative to one another is situated in a printing position during the printing. The print carriage is designed accordingly in order to be moved forward—transverse to the mail piece transport direction—starting from the printing position into an exchange position. The exchange position lies at the front side of the printing device or above the transport region of a transport device that is thereby designed accordingly. The transport region is situated at the front side of the printing device, and the printing region adjoins this to the rear.

From German Patent Application DE 102008033052 A1, an arrangement for exchanging ink cartridges is known that has a print carriage with a shaft-like receptacle for ink cartridges. The contact panel of the contacting and control electronics on the back side of each shaft has a number of counter-contacts. The counter-contacts are arranged so as to be adjustable and are mechanically coupled with the latch of a locking mechanism so that the counter-contacts are distanced from the ink cartridge simultaneously with the unlocking of the ink cartridge, and the counter-contacts are contacted with the contact panel and a chip on the ink cartridge with the locking of the ink cartridge. The latch serves as a locking lever and interacts with a locking projection on the edge between the narrow top side and the narrow back side of the ink cartridge, wherein the locking projection is matched to the contour of the latch.

In the European Patent EP 1 880 857 B1, an arrangement for exchanging ink printing modules was proposed, wherein what are designated with the latter term are ink cartridges that can be inserted directly into a receptacle of the pivot device. The arrangement has latches to lock the ink cartridges and, per ink cartridge, a draw hook mechanically connected with a retaining spring as well as a guide lever. After the exchange, the retaining springs pull the draw hooks back into a starting position. This device attached to the ink cartridge receptacle for the exchange of said ink cartridges is materially intensive and can lead to a contamination problem given a disadvantageous manual operation of the draw hooks, because the lower trailing edge of the nozzle surface of the ink cartridge rests on an elastic part that should prevent contact of the counterpart with the contact panel, but the clearance is so small that contact of the counterpart to the contact panel due to contamination therebetween cannot be precluded. The contact problem results from the fact that the clearance is small and the elastic part and the contacts can be contaminated with ink upon removal of the ink cartridge, such ink having accumulated on the lower trailing edge during the printing. The draw hook and the elaborate mechanism of the aforementioned prior art are disadvantageous to an easy exchange of the ink cartridges.

In German Patent DE 10 2008 030 530 B4, an ink cartridge receptacle is disclosed that has neither draw hooks nor the elaborate locking mechanism of the aforementioned prior art, and given which the contamination problem is remedied. The ink cartridge has been modified by a guide pin that is attached to the bulge or between bulge and head of the ink cartridge and projects past the flat side wall only on one side for the purpose of guiding the ink cartridge. While inserting the ink cartridge, the guide pin slides along into a connecting guide member in a wall of an ink cartridge receptacle. Given an inserted ink cartridge, a leaf spring is pre-tensioned in each cavity of the cartridge carrier (which cavity is provided for an ink cartridge) of the ink cartridge receptacle, and the exchange of the ink cartridge is assisted by spring force when the locking projection and the locking element of the ink cartridge carrier disengage per manual pressure on the ink cartridge and the ink cartridge is pivoted on an axis traveling nearly parallel to the guide pin in order to unlock the ink cartridge, wherein the clearance of the lower trailing edge of the ink cartridge from the contact panel of the cartridge carrier is precisely determined by the course of the connecting guide member.

A franking machine is known from German Utility Patent DE 202012005904 U1 that has an ink printing device onto which a flat good is pressed by a contact pressure device. The ink printing device includes exchangeable ink cartridges. Instead of a leaf spring, in the ink cartridge receptacle a compression spring is used via whose spring force the exchange of the ink cartridge is assisted after the locking projection and the locking element of the ink cartridge carrier have been disengaged per manual pressure. An advantage of the manual handling is that the ink cartridge is held in the hand after the contacts are released, and therefore the ink cartridge does not spring out of the cartridge carrier far enough so that the ink cartridge reaches the opened hatch of the franking machine.

A commercially available franking machine Mymail® from Francotyp Postalia GmbH (which has a very small structural shape) provides sufficient space for neither a leaf spring nor a compression spring in the cavity of the cartridge carrier for accommodation of the ink cartridge; see EP 1127701 B1. Given an activated franking machine, at any point in time before printing a cover can be opened, a release can be unlocked and the ink cartridges can be removed. During the printing, the ink cartridge moves and therefore cannot be exchanged. The cartridge carrier (formed from two side parts in a manner known per se) is mounted on a sled in a known manner, which sled is arranged so as to move by sliding on a guide rod. The outside of the right-side part is designated in the following as what is known as the sled side, since this is provided for mounting of the cartridge carrier on the sled. The outside of the left-side part is designated as what is known as the connection side since this is provided for connection of a ribbon cable for conductive connection of the electrical terminal contacts of the ink cartridge with the control unit. The installed cartridge carrier has in a known manner an upward opening for sliding the ink cartridge into a cavity, and a narrow wall bent outward from the outer edge of the left-side part and right-side part. Given a small structural shape of the cartridge carrier with connecting guide member, a compression spring would be unsuitable in order to supply a force that would be necessary to convey the ink cartridge out of the cavity. The compression spring would need to be realized so as to be strongly compressible during the insertion of the ink cartridge into the cavity of the cartridge carrier of the ink cartridge receptacle, which requires an additional structural space. It is furthermore disadvantageous that the ink cartridge can also be manually exchanged when the cartridge carrier is rotated into a sealing position for the ink cartridge. The print head could be damaged if, given manual operation, the ink cartridge is pushed in too far in order to press the locking edge of the ink cartridge past an edge at the opening of the cartridge carrier. The print head of the ink cartridge could thereby be damaged given a contact with the service station. All of this is disadvantageous given a manual handling of the ink cartridges.

SUMMARY OF THE INVENTION

An object of the invention is to develop a printing apparatus in which the disadvantages of the prior art upon changing an ink cartridge (i.e. during the process of inserting and removing the ink cartridge) are remedied. It should be ensured that the ink cartridge can be exchanged only when the cartridge carrier has been driven or rotated before the exchange, into a position that is predetermined for exchanging cartridges when it arrives in the exchange position from a sealed position. Additionally, manual operating errors during the exchange should be precluded. A solution for unlocking the ink cartridge should be achieved in which an operator does not need, and preferably should not be able, to directly contact the ink cartridge for this purpose. Damage to the print head should be avoided. The cartridge carrier should have a suitable design shape that prevents the ink cartridge from being pushed too far into the cavity during the plugging of the ink cartridge into the cartridge carrier. Given retention of a connecting guide member during the insertion and movement of the ink cartridge in the cavity of the cartridge carrier counter to the elastic effect of a spring, a solution should be achieved for an even smaller structural space than is available in the cartridge carrier of the aforementioned Postbase® franking machine. After inserting the ink cartridge into an opening in the cartridge carrier, the ink cartridge should be locked in said cartridge carrier. The ink cartridge should be unlocked at the cartridge carrier before an exchange.

A manual contact with the ink cartridge should be avoided entirely up to a point in time at the beginning of the process of removing the ink cartridge from the cartridge carrier, wherein this point in time is achieved only after a separation of the electrical connection from the contacts of the ink cartridge.

A spring force should not only be active to assist in the removal process of the ink cartridge, but also the effect of the spring force should also be limited and dimensioned so that the ink cartridge does not spring too far up out of the cartridge carrier before it can be grasped by a hand. It should be prevented that the upwardly moving ink cartridge strikes the opened hatch of the franking machine.

After the unlocking and removal of the used ink cartridge, the opening to the cavity in the cartridge carrier should remain freely accessible until the opening is required for the insertion of another ink cartridge filled with ink.

The object is achieved with the features of the printing apparatus according to invention, wherein the cartridge carrier has a cavity for insertion of an ink cartridge, and a locking-and-ejection mechanism is arranged on the outside of a side part of the cartridge carrier. The outside of the respective other side part is called the sled side, on which a sled is mounted. The locking-and-ejection mechanism is mounted on the outside of the aforementioned side part, i.e. on the connection side for a ribbon cable. In a printing apparatus designed for right-handed operation, this connection side is the left-side part of the cartridge carrier when the printing apparatus is viewed from the front.

The locking-and-ejection mechanism has a locking mechanism with a locking lever biased by a spring force produced by a first spring. The locking lever is pivotable on a rotation axis that is situated on the outside of the side part. The locking-and-ejection mechanism furthermore has an ejection mechanism with a lifting plate biased by a spring force produced by at least a second spring. This lifting plate is arranged on the outside of the side part so as to be rotatable on a rotation axis, with the rotation axis of the lifting plate being arranged stationary on the outside of the side part. The lifting plate is biased by a spring force from a two-stage spring system, wherein the spring force is dimensioned such that an ink cartridge can be released, lifted up, and ejected from the cartridge carrier.

The locking lever has a first locking mechanism and a second locking mechanism, wherein the second locking mechanism is provided to lock the first locking mechanism. An actuator is provided to unlock the latch of the second locking mechanism. The lifting plate is arranged so as to be rotatable so far that the locking lever is held in an unlocked position after an ejection of an ink cartridge. Because the rotated lifting plate keeps the locking lever in an unlocked position, this prevents the projection from being unintentionally locked given an ejected ink cartridge. An unwanted unlocking of the first locking mechanism can similarly be prevented by the second locking mechanism.

In a housing part of the printing apparatus (viewed from the front), the actuator is arranged above and next to the ink cartridge so that a locked ink cartridge can be unlocked only when the locking-and-ejection mechanism is in a predetermined position and at a predetermined distance D from a tip of the actuator. The locking-and-ejection mechanism has a locking mechanism that can be unlocked via a release mechanism. The release mechanism can be released by the actuator only in the predetermined position. For this purpose, before exchanging the ink cartridge, the print carriage of the printing apparatus must be driven to a side wall that is provided for exchanging the ink cartridge, or the print carriage must be rotated into this position. The print carriage has (as is known) a toothed belt and a sled that slides on a guide rod, wherein that side of the print carriage on which the sled is mounted is called the sled side in the following. The respective other side is called the connection side in the following.

An additional position is provided for sealing and servicing the ink cartridge. This additional position is achieved after the print carriage, with an ink cartridge inserted into the cartridge carrier, has been moved to a housing side wall and the print carriage is then rotated around an axis of the guide rod so that the cartridge carrier is tilted forward. Given a printing apparatus suitable for right-handed use, this is the right side wall of the housing within the printing apparatus viewed from the front. The release mechanism of the cartridge carrier tilted forward can then no longer be released via the actuator because, due to the rotation, the release mechanism and the actuator have been moved beyond the distance D that enables a release. Damage to the print head of the ink cartridge can advantageously be avoided since, in this position, the ink cartridge can neither be exchanged nor pushed too far into the cavity. It is thus avoided that a contact with the service station occurs and that the print head can be damaged.

The release mechanism is formed by a compression spring and a resiliently elastic hook support of a locking lever, wherein the hook support is equipped with a release trigger surface and with a notch at the end of which a snap-in hook is molded. The hook support is molded on a connecting part on the short end of the lever arm, and a bearing peg for the compression spring is fashioned below the connecting part on the short end of the lever arm. In a preferred variant, the release mechanism and a cartridge locking projection are molded on the end of the mounted locking lever, this end being directed upwardly. For the purpose of locking the locking lever, the snap-in hook is arranged in a window-shaped opening in the narrow wall angled outwardly on the upper edge of the left-side part of the cartridge carrier.

The cartridge carrier has the following advantages and modes of operation.

The insertion movement of the ink cartridge during the insertion into the cartridge carrier is limited by one end of the connecting guide member on the inside of the side part on the sled side. This prevents the ink cartridge from being pushed too far into the cavity, and a cartridge carrier with very small structural shape can be realized.

A tension spring of the ejection mechanism is arranged on the outside of the connection side of the cartridge carrier, instead of the previously used spring inside the cavity that has been described above. The tension spring interacts with a lifting plate; the two form only one part of the ejection mechanism. A small finger to lift the ink cartridge is angled inwardly at the lifting plate of the ejection mechanism, thus directed into a space of the cavity. It is called the cartridge lifting finger in the following and engages in a space in the region between bulge and neck of the ink cartridge. A spacer part at the floor of the cartridge carrier has a recess for the cartridge lifting finger.

Moreover, the ejection mechanism includes a u-shaped molded plate with a downwardly directed end that, in the installed state, is positively connected with a floor plate at the connection side of the cartridge carrier. The u-shaped molded plate has two side parts and a middle part with a flat base surface into which a hole is worked near the other end. The u-shaped molded plate is mounted on an attachment peg. The attachment peg protrudes outward on the connection side of the cartridge carrier and through the aforementioned hole. At that end that is directed upward in the installed state, the one side part of the u-shaped molded plate has a right-angle bend with a counter-bearing element for a compression spring. The compression spring is plugged at one end onto a bearing peg of a locking lever and at the other end is tensioned and mounted on the counter-bearing element. A gap in which the lifting plate of the ejection mechanism is mounted so as to be movable exists between the base surface of the downwardly directed side of the installed, u-shaped molded plate and the outer surface of the connection side of the cartridge carrier. The installed lifting plate has two support fins in the middle. At the one end of the lifting plate, a finger to lift the ink cartridge is molded on an inwardly directed bend. In addition to the finger, a suspension hole for the compression spring is also arranged at an outwardly directed bend of the lifting plate. A bearing hole is arranged at the other end of the lifting plate. The lifting plate is installed with its bearing hole on a bearing peg on the connection side, wherein the bearing peg enables a rotation movement of the lifting plate around a rotation axis during the ejection of the ink cartridge.

Given an inserted ink cartridge, on the one side a torsion spring engages at the aforementioned lifting plate; on the other side the torsion spring is arranged on the outside of a side wall of the cartridge carrier so that the spring force of the torsion spring acts only up to a stop molded on the connection side of the cartridge carrier. The ink cartridge is conveyed out of the cavity with a first force when the ejection mechanism is released for this. On the connection side (i.e. outside of the left-side part of the cartridge carrier), a locking lever is arranged so that a longer, downwardly directed lever arm of the locking lever is arranged next to the u-shaped molded plate. At its end the long lever arm has a control contour. A projection for locking the cartridge is molded on the opposite end of a short lever arm of the locking lever. Only when the sled has been moved into a position predetermined for exchanging cartridges is the actuator positioned at the end of the short lever arm of the locking lever so that it can act on the locking lever upon actuation and release this. The release mechanism arranged between the actuator and the locking lever can then unlock the locking lever upon actuation of the actuator, and thus release the ejection mechanism. In the preferred embodiment, the release mechanism is a component of the locking lever. In this variant, the release mechanism is formed by a compression spring and a resiliently elastic hook support that has a release trigger surface and a snap-in hook molded at its end pointing in the direction of the cartridge locking projection. Upon locking of the ink cartridge, the snap-in hook rests in a window-like opening in a narrow wall angled outward from a top edge of the left-side part. The window-like opening is open toward the cavity so that the projection protrudes into the cavity to lock the cartridge. Given an actuation of the release trigger surface, the resiliently elastic hook support is pushed out of the opening and the compression spring is relaxed, whereby the locking lever is moved so that the cartridge locking projection no longer protrudes into the cavity. The ejection mechanism is released by relaxing the compression spring in that the locking lever flips in a rotation axis so that the end of the long lever arm is moved onto the left side wall of the cartridge carrier. The control contour of the locking lever interacts with the drive lugs of the lifting plate so that said lifting plate performs a rotation movement around a rotation axis. The ink cartridge is first accelerated via the spring force on the torsion spring (which acts on the lifting plate) to a velocity, and then a braking contour in the upper third of the groove of the connecting guide member on an inner wall of the cartridge carrier brakes the further movement of the ink cartridge to the extent that the ink cartridge cannot move too far upward. The spring force of the aforementioned tension spring supports the removal of the ink cartridge. However, it is too weak to cause the ink cartridge to jump upward out of the cartridge carrier so far that said ink cartridge strikes the opened hatch of the franking machine. The very simple structural design of the kinematic coupling of the actuation means with the locking lever is important. For example, the actuator mounted in the upper part of the housing is a button. This button is situated over the release trigger surface of the hook support of the release mechanism when the ink cartridge inserted into the cartridge carrier has been moved into the position provided for exchanging the ink cartridge. Otherwise, the button and the release mechanism are not engaged and cannot interact further.

DESCRIPTION OF THE PREFERRED EMBODIMENTS

Figure 1:
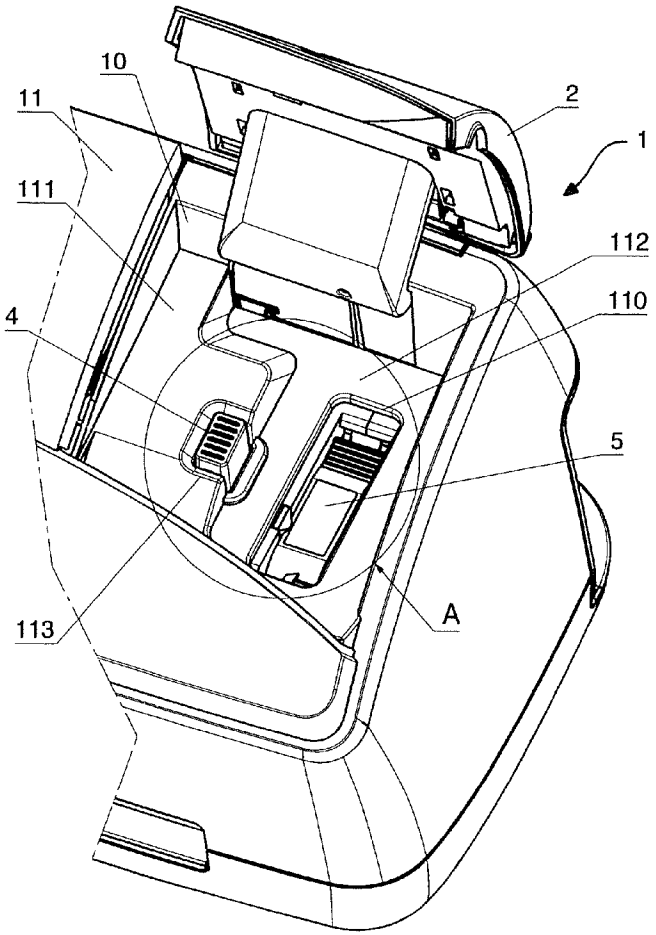
FIG. 1 shows the right half of a printing apparatus in perspective depiction from the front upper right, with an opened hatch.

FIG. 1 shows a right half of a printing apparatus 1 with opened hatch 2 in a perspective view as seen from the top front right. A recess 10 is provided in the region which the hatch covers in the closed state. In this region, at a first level 111 under the top side of the upper housing part 11, the housing of the upper housing part 11 of the printing apparatus 1 extends further to the right, approximately to the middle of the opening 10, and then transitions into a second level 112. The second level 112 has a base in which a second window-like opening 110 is molded, for the exchange of the ink cartridge 5 inserted into a cartridge carrier. A third opening 113 in the base surface of the first level 111 is situated at the edge of the second level 112 of the upper housing part 11 of the printing apparatus 1. A cuboid actuator 4 projects upwardly out of the third opening 113. The upper edge of the cuboid actuator 4 is situated in line with the upper level edge and at approximately the same height, which is shown in Detail A in FIG. 1*a*.

Figure 1A:
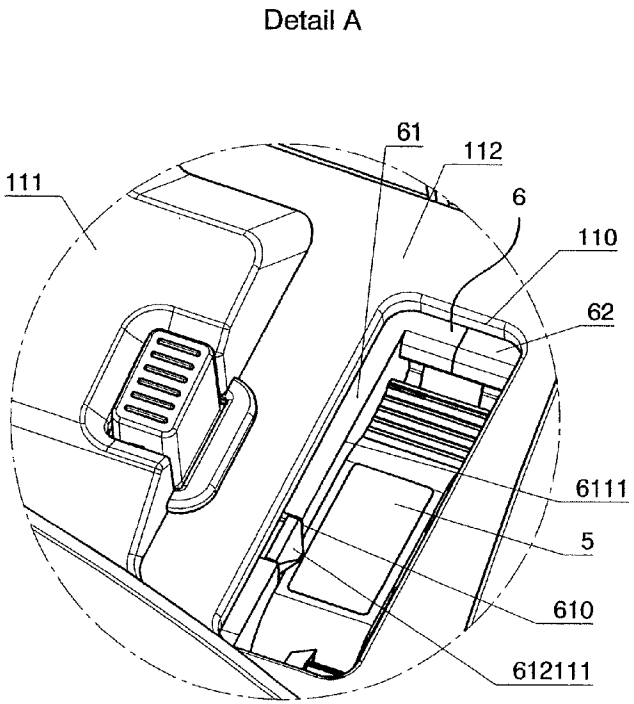
FIG. 1*a* shows Detail A of FIG. 1.

FIG. 1*a* shows a perspective presentation of Detail A. The cuboid actuator is preferably a button. The one upper edge of the button is preferably situated coplanar with the upper level edge of the first level 111. The upper level edge travels sloping upward to the rear and then bends at a right angle to the left to form a bent upper level edge. The second window-like opening 110 in the second level 112 extends approximately the same distance up to the bend. The cartridge carrier 6 is composed of two side parts 61, 62. The ink cartridge 5 (which previously had been inserted into the cartridge carrier 6) is secured against a manual removal by a projection 612111 for cartridge locking. A window-like opening 610 in which the projection 612111 is directed so as to be movable is arranged in a narrow wall angled outward from the upper edge 61111 of the left-side part 61.

Figure 2:
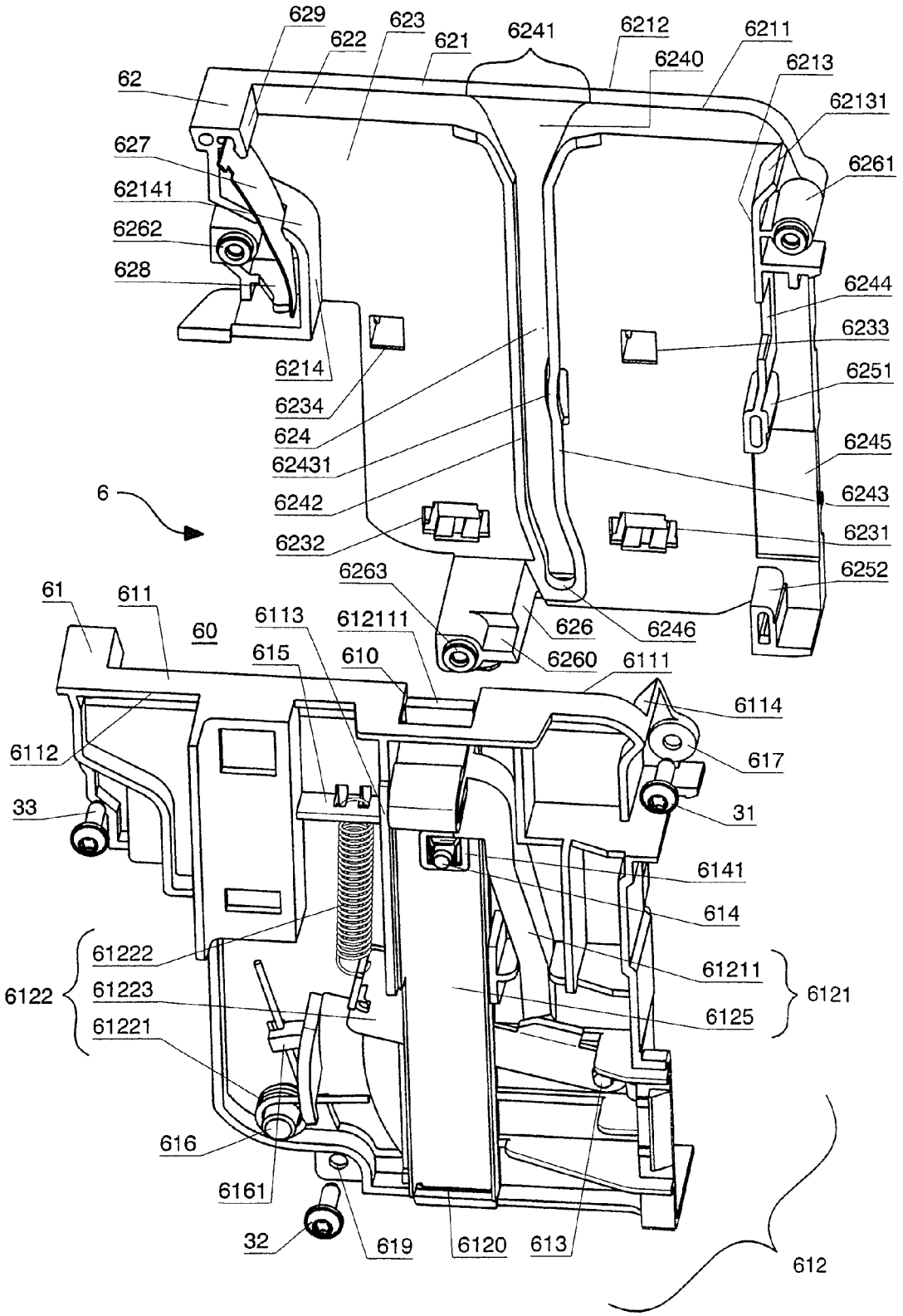
FIG. 2 is exploded view of a cartridge carrier.

FIG. 2 is an exploded presentation of a cartridge carrier 6 from the front upper left. The cartridge carrier is composed of a right-side part 62 and a left-side part 61, both of which are respectively shaped on their inside so that a cavity 60 is formed for the insertion of an ink cartridge if both side parts are combined. A bent wall 621 on the upper edge of the right-side part 62 has an inner edge 6211 and an outer edge 6212. Molded on the inner edge 6211 is an insertion slope 622 that extends in to the lateral inner wall 623 of the right-side part 62, wherein the surface of the inner wall 623 delimits the cavity at the sled side. The inner wall 623 is interrupted in the middle by a connecting guide member 624 that has a funnel-shaped insertion opening 6241 whose floor surface 6240, as of the inner edge 6211, proceeds at a right angle to the surface of the bent wall 621, from top to bottom up to an end 6246 of the connecting guide member. The connecting guide member has on both sides a raised edge 6242, 6243 that marginally projects beyond the surface of the inner wall 623. The edge 6243 that is directed toward the print head side of the cavity has an elastic, curved region 62431 that is fashioned as a brake in order to brake the movement of an ink cartridge (not shown) in the connecting guide member. The cartridge carrier has an insertion slope 62131 at an inner wall 6213 on the front side of the right-side part and the same insertion slope (the manner is not shown) at an inner wall on the front side of the left-side part 61. Two window-like openings 6244 and 6245 are situated on the print head connection side of the cavity for electric connection of an ink cartridge inserted into the cavity. Both openings 6244 and 6245 are spaced apart from one another by a first web 6251. The first upper opening 6344 is square and situated between the web 625 and a first attachment hole 6261, wherein the latter is arranged on the front side of the cartridge carrier 6 and near the insertion opening of said cartridge carrier 6, wherein the insertion opening serves for the insertion of an ink cartridge (not shown) into the cavity. On the opposite narrow back side of the right-side part 62, a leaf spring 627 is tensioned between a clamping device 628 and a collar 629 of the right-side part 62. The clamping device 628 is formed between a second attachment hole 6262 on the back side of the right-side part 62 and an inner wall 6214. An insertion slope 62141 has a slot 62140 for the leaf spring 627 and extends into the cavity up to the inner wall 6214. The collar 629 of the right-side part 62 is bounded by the insertion slope 622 at the sled side of the cartridge carrier 6 and upwardly by the inner edge 6211. A spacer part 626 and a third attachment hole 6263 are molded on the base of the right-side part 62 of the cartridge carrier 6, near the connecting guide member. The spacer part 626 has a cutout 6260 for a cartridge lifting finger (not shown). A second web 6252 is separated from the first web 6251 by a length of the lower window-like opening and is molded on the print head connection side of the cavity on the floor of the side part 62. A respective receptacle 6231, 6232 for a bearing sleeve (hidden) of a bearing axle (131; see FIG. 5*b*) is molded into the lateral inner wall 623 of the right-side part 62, near the floor of the cartridge carrier on both sides of the connecting guide member 624. Moreover, clearances 6233, 6234 for guides (not visible) of a bearing axle (132; see FIG. 5*b*) are molded approximately in the middle of the cavity in the lateral inner wall 623 of the right-side part 62.

An installation (not shown) of the side parts 61 and 62 takes place via three attachment elements 31, 32 and 33 via three holes 617, 618 (see FIG. 9) and 619 that are molded into the periphery of the left-side part 61 and are associated with the attachment holes 6261, 6262 and 6263 of the right-side part 62. The first and second attachment hole 6261, 6262 as well as the associated first and second holes 617, 618 (hidden) are arranged in the upper part of the cartridge carrier 6, respectively on the outside of the narrow forward inner wall 6213 and on the outside of a narrow rear inner wall 6214, wherein the inner walls are situated near the opening for the insertion of an ink cartridge into the cavity 60. A bent wall 611 has an additional window-like opening 610 with a width that extends up to the cavity 60 and transitions into this, wherein the opening 610 is shaped approximately as a square in plan view of the wall 611, and is arranged between the middle of the upper edge of the left-side part 61 and the front part of the cartridge carrier 6. The opening 610 has a length L and begins two lengths removed from the narrow front inner wall (6115; see FIG. 9) on the front side of the left-side wall 61. An insertion slope 6114 on the inner wall (covered in FIG. 2) of the left-side part 61 facilitates an insertion of the ink cartridge. A locking-and-ejection mechanism 612 is installed on the outer wall of the left-side part 61. The locking-and-ejection mechanism 612 is composed of a locking mechanism 6121 with a locking lever 61211 and a compression spring (hidden). Both are held in position by a u-shaped plate 6125 that has an insertion surface at the plate end, which insertion surface is inserted into a pocket 6120, wherein the pocket is molded on the outer edge of the floor of the left-side part 61. The locking-and-ejection mechanism 612 also includes an ejection mechanism 6122 with a torsion spring 61221, a tension spring 61222 and a lifting plate 61223. The tension spring 61222 is tensioned between a base 615 of a first bay below the bent wall 611 and a free end of a lever arm of the lifting plate 21223. The first bay has a rectangular shape and is arranged on the outer surface of the left-side part 61 in the rear half of the cartridge carrier 6. An additional rectangular bay on the outer surface of the left-side part 61 is provided for the u-shaped plate 6125 and arranged next to the first bay. The length of the additional bay corresponds to the width of the projection 612111 of the locking lever 61211 in addition to a tolerance value. The length of the first bay is approximately two-thirds of the length of the additional bay. A dividing wall 6113 separates the first bay from the additional bay and extends continuously downward up to approximately the middle of the left-side part 61. An attachment peg 614 is molded in the middle of the additional bay. The u-shaped plate 6125 has a hole 61251 near one end thereof and is plugged with this hole 61251 onto the attachment peg 614 and is attached to this with a spring nut 6141. The lifting plate 61233 is rotatable around a bearing peg 613 and is arranged in an intervening space between the u-shaped plate 6125 and the outer surface of the left-side part 61. The rotation peg 613 is molded on the outer surface of the left-side part 61 near the narrow forward side edge and at the level of the middle of the lower window-like opening 6245. The two legs of the torsion spring 61221 respectively rest on a stop 6161 (and 6162, see FIG. 9). The stops and a bearing peg 616 for the torsion spring 61221 are molded on the outer surface of the left-side part 61. The bearing peg 616 is arranged near the lower rear corner of said left-side part 61. The one stop 6161 for the one leg of the torsion spring 61221 is arranged above the bearing peg 616.

Figure 3B:
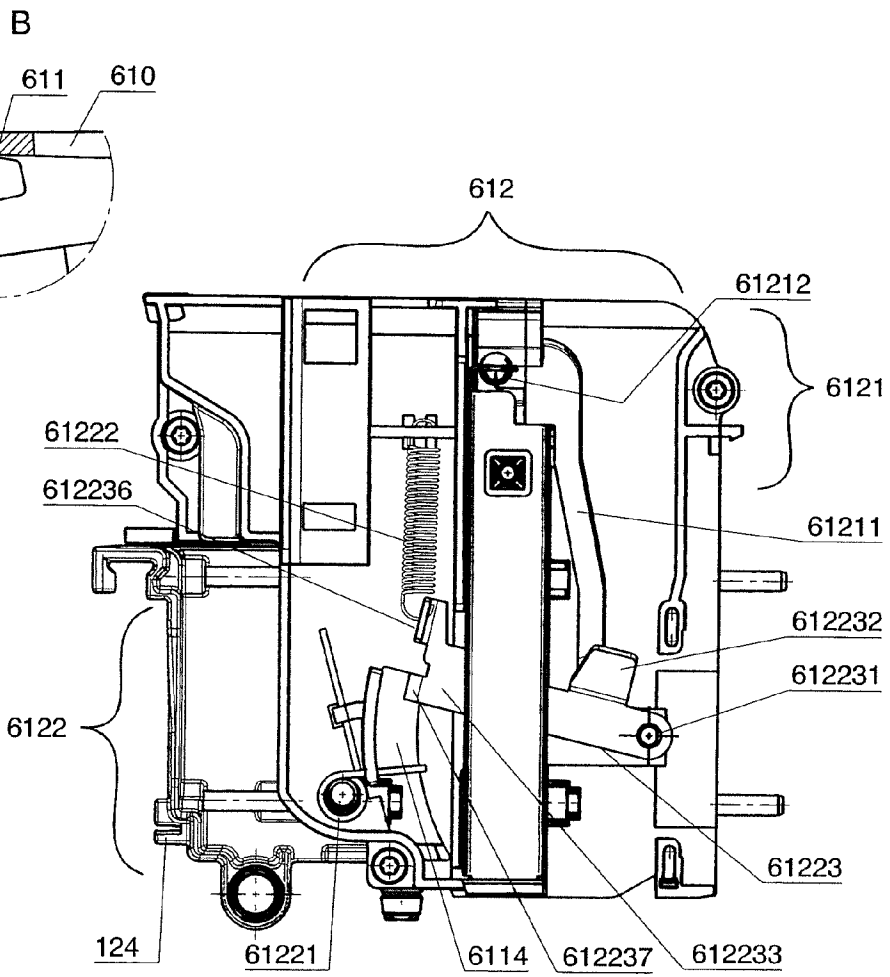
FIG. 3*b* is a side view of the cartridge carrier according to FIG. 3*a*, from the left.
Figure 3A:
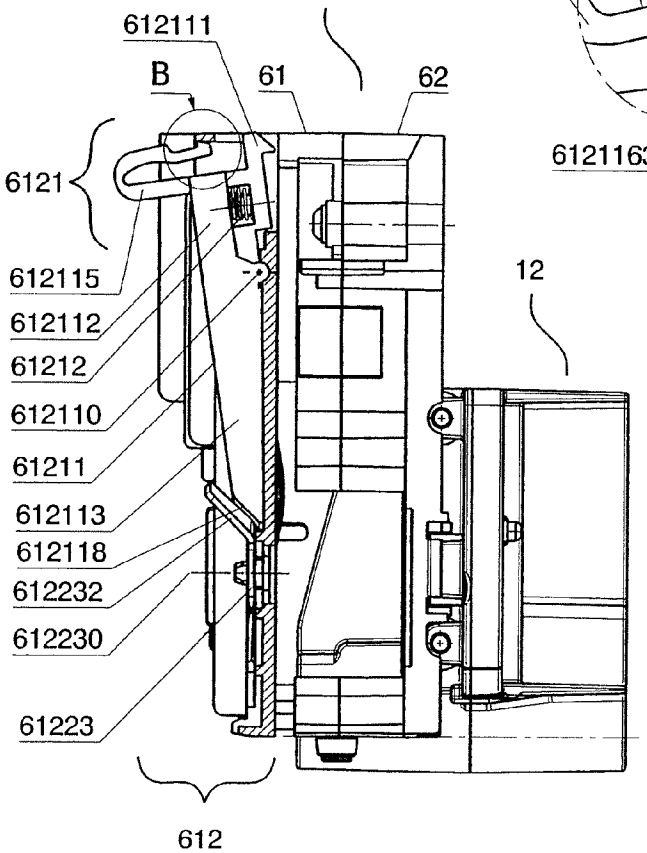
FIG. 3*a* is a front view of the cartridge carrier without an ink cartridge therein.

FIG. 3*a* shows a front view of the cartridge carrier 6 without ink cartridge. The wall (shown in section) of the side part 61 shows the locking-and-ejection mechanism 612 arranged on the connection side of the left side part 61. The locking lever 61211 has a long lever arm 612112 that ends in a control contour 612118 which interacts with a drive lug 612232 of the lifting plate 612233, wherein the latter holds the locking lever 61211 in an unlocked position. The shown unlocked state of the locking-and-ejection mechanism 612 is assumed after the ejection of the ink cartridge and remains until an ink cartridge is plugged into the cavity again. The locking lever 61211 is mounted such that it can be pivoted or tilted around a rotation axis 612110 on the connection side of the side part 61. The locking mechanism 6121 has a short lever arm 612112 and a compression spring 61212 that—in the shown unlocked state—is compressed between the short lever arm 612112 and a counter-bearing point (not visible here) at one end of the u-shaped plate, such that the spring is under a pre-tension that acts on the short lever arm. The short lever arm 612112 branches at the lever arm end into a projection 612111 and a connecting piece 612115, wherein the projection 612111 points towards the cavity and the connecting piece 612115 is directed away from the cavity. In the shown unlocked state, the short lever arm is tilted away from the connection side of the cartridge carrier 6. Due to a control contour 612118 molded on its lever end, the long lever arm 612113 of the locking lever 61211 is pressed against the outer surface of the side part 61 because the drive lug 612232 at the lever arm of a lever plate 61223 acts on the control contour 612118. The rotation axis 612230 of the lifting plate 61223 proceeds orthogonally to the rotation axis 612110 of the locking lever 61211.

A Detail B of FIG. 3*a* is depicted enlarged and shows a snap-in hook 6121163 at the end of a notch 6121162 of a hook support 612116 that is molded so as to be elastic on the connecting piece 612115 of the locking lever 61211, wherein the snap-in hook 6121163 rests on the connection side of the side part 61, below the bent wall 611 of the side part 61, near the opening 610. A sled 12 is installed on the sled side of the cartridge carrier 6, i.e. the outer wall of the right-side part 62.

FIG. 3*b* shows a side view of the cartridge carrier according to FIG. 3*a* from the left. An attachment part 124 is provided on a rear wall of the sled in order to attach a toothed belt (not shown) that can move the print carriage sliding back and forth on a guide rod (not shown). The locking-and-ejection mechanism 612 has a locking mechanism 6121 that is unlocked in the shown state so that the opening for insertion of an ink cartridge into the cavity of the cartridge carrier 6 remains open. The compression spring 61212 is compressed by the tilted locking lever 61211 only so far that a predetermined pre-tension is maintained. The locking-and-ejection mechanism 612 is installed on the connection side of the side part 61, the ejection mechanism 6122 of which is composed of the torsion spring 61221, the tension spring 61222 and the lifting plate 61223.

The ejection mechanism 6122 is shown in a state after the ejection of an ink cartridge from the cavity of the cartridge carrier 6. The tension spring 61222 and the torsion spring 61221 form a two-stage spring system that acts on the lever arm 612233 of the lifting plate 61223 before the ejection of an ink cartridge from the cavity of the cartridge carrier 6. Given an unlocked locking lever 61211 (see FIG. 3*a*), a cartridge lifting finger 612237 on the lever arm end of the lifting plate 61223 can raise the ink cartridge. Due to the course of the connecting guide member (see FIG. 2) on the side part 62, inside the cavity the ink cartridge is raised from the front side of the cartridge carrier 6. The torsion spring 61221 is only active until a leg of the torsion spring 61221 arrives at the stop. The tension spring 61222 of the two-stage spring system is continuously active. At the edge of the connecting guide member 624, an elastic, curved region 62431 (FIG. 2) is provided that brakes the movement of the ink cartridge during the ejection. After a detachment of the electrical connection with the contacts of the ink cartridge, a point in time is reached that marks the beginning of the removal process of the ink cartridge from the cartridge carrier. A manual contact with the ink cartridge can thus be entirely avoided up to this point in time, The lifting plate 61223 has a bearing hole 612231, the drive lug 612232 to hold the locking lever 61211 in the shown unlocked state, the lever arm 612233 with an angle piece 612236 and the cartridge lifting finger 612237 at the end of the lever arm. With the bearing hole 612231, the lifting plate 61223 is mounted so as to be rotatable on a bearing peg on the connection side of the side part 61. The tension spring 61222, which is attached with the one end in a spring suspension hole 6122360 of the angle piece and with the other end at the floor of the first bay, is under a pre-tension. The cartridge lifting finger 612237 at the end of the lever arm of the lifting plate 61223 engages through a curved opening 6114 of the left-side part 61 and rests in a stop on the upper end of the curved opening.

Figure 4B:
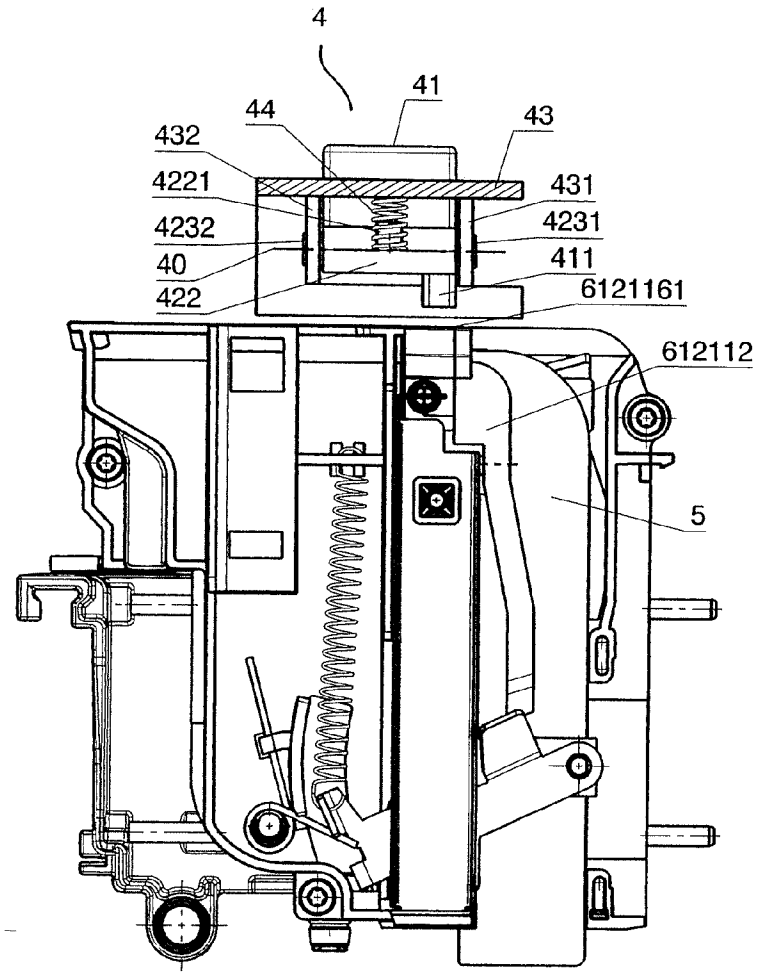
FIG. 4*b* is a side view of the cartridge carrier according to FIG. 4*a*, from the left.
Figure 4A:
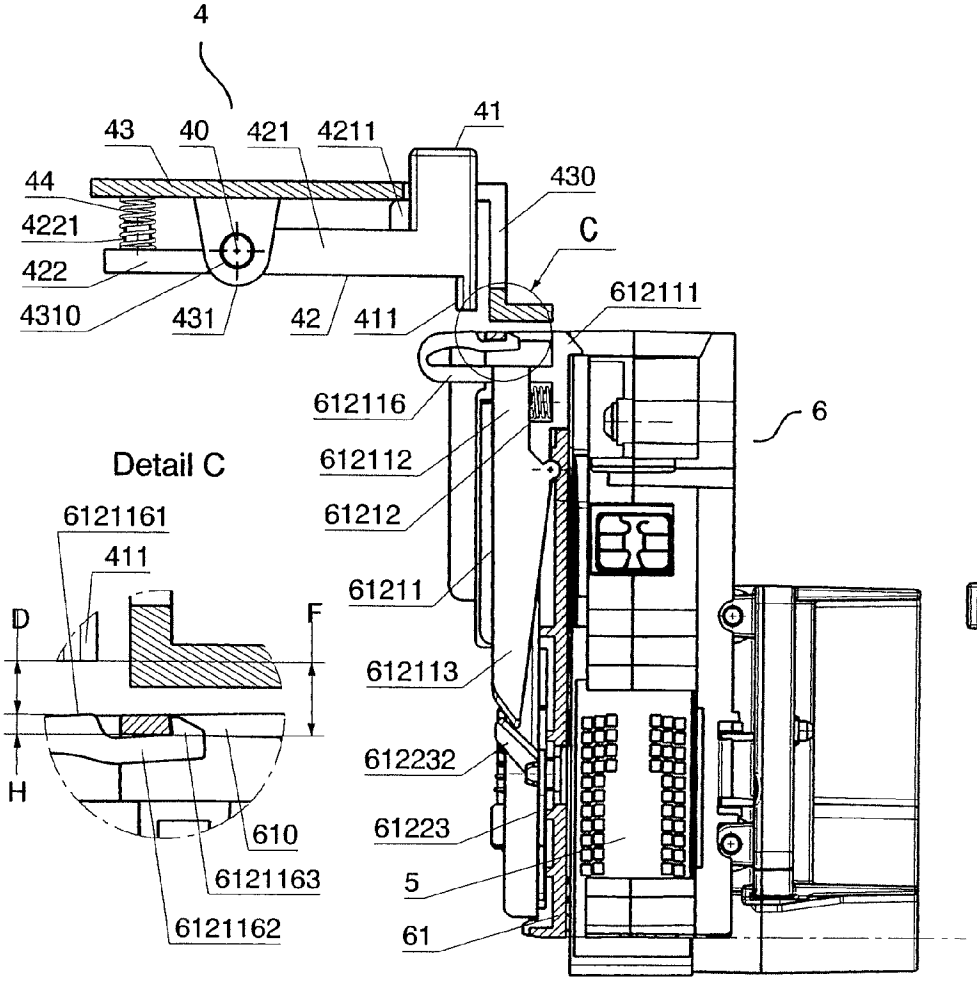
FIG. 4*a* is a front view of the cartridge carrier with an inserted ink cartridge.

FIG. 4*a* shows a front view of the cartridge carrier 6 with inserted ink cartridge 5. As a result of the insertion of the ink cartridge 5, the cartridge lifting finger 612237 at the end of the lever arm of the lifting plate 61223 is pressed down against the spring force effect of the two-stage spring system, and the short lever arm 612112 of the locking lever 61211 is pivoted onto the outer surface of the left-side part 61 of the cartridge carrier 6 via the spring force effect of the compression spring 61212. The projection 612111 thereby locks the inserted ink cartridge 5. After pivoting on, the locking lever 61211 is held in the shown locking state by the snap-in hook 6121163, which now arrives in the opening 610. The snap-in hook 6121163 locks the projection 612111 which then locks the inserted ink cartridge 5. The projection 612111 cannot be manually removed from the inserted ink cartridge 5 as long as the snap-in hook 6121163 engages in the opening 610 (Detail C). The resiliently elastic hook support 612116 has a release trigger surface 6121161 that is removed from the snap-in hook 6121163 via the notch 6121162. The snap-in hook is molded at an end of the hook support 612116 pointing in the direction of the cartridge lifting finger. The actuator 4 is formed by the button 41; an actuation lever 42; a wall 43 that is arranged below the first level of the upper housing part and is drawn in section; and a compression spring 44. The actuation lever 42 has a longer lever arm 421 and a shorter lever arm 422 and can be tilted on a rotation axis 40. The button 41 has a trigger finger 411 molded facing downward at the one end of the longer lever arm 421. At the end of the shorter lever arm 422, a peg-shaped lower stop 4221 is fashioned that extends in the same direction as the button 41 and is plugged onto the compression spring 44. Given an actuation of the button 41, the actuation lever 42 charged with a spring force of the compression spring 44 tilts only until the stop peg 4221 strikes the wall 43 below the first level of the upper housing part. An upper stop 4211 is molded on the long lever arm of the actuating lever, wherein the stop 4211 extends in the same direction as the button 41 and is fashioned in the shape of a block. Due to the spring force of the compression spring 44, the stop block 4211 stops at the wall 43 below the first level of the upper housing part when the button is not actuated. The wall 43 has an opening 430 for the button 41 and a mount 431 (and 432, covered) for the actuation lever 42. The mount 431 (432 covered) has bearing holes 4310 (4320 covered) for the bearing of two rotation pegs 4231 (4232 covered) of the actuation lever 42. An ink cartridge exchange position is reached due to the movement of the print carriage. After the movement of the print carriage or, respectively, rotation of the cartridge carrier, the release trigger surface 6121161 is arranged, positioned at the trigger finger 411, so that the latter compresses the ends of the hook support 612116 (the manner is not shown) upon actuation of the button 41. The snap-in hook 6121163 thereby disengages with the inner edge of the opening 610, and the spring force of the compression spring 61212 that presses the short lever arm 612112 of the locking lever 61211 onto the outer surface of the side part 61 is overcome, and the projection 612111 is therefore also released. A distance D up to the release trigger surface 6121161 of the hook support 612116 is thereby initially overcome by a tip of the trigger finger 411, and after this the snap-in hook 6121163 disengages with the inner edge of the opening 610, wherein the snap-in hook overcomes a vertical travel H, wherein the vertical travel H corresponds to at least the thickness of the bent wall 611 (FIG. 2) in the region of the opening 610 (Detail C). Production tolerances must also be considered, which is why the release travel F must be increased by a safety tolerance S of approximately +1 mm. For the tip of the trigger finger 411, a release travel F is thus provided that results from a sum of distance D, vertical travel H of the snap-in hook and a safety tolerance S. The actuation lever 42 has dimensions that ensures the necessary release travel F. The stop peg 4221 of the actuation lever 42 thereby limits the release travel F to the extent that the resiliently elastic hook support cannot be compressed so far that it breaks. The projection and the resiliently elastic hook support are molded on the one end of the short lever arm of the locking lever. At the other end of the long lever arm 612113 of the locking lever, a control contour is fashioned which transfers the spring forces acting on the lifting plate 61223 to the long lever arm 612113 of the locking lever by means of a drive lug 612232. The long lever arm 612113 can then act (the manner is not shown) on the short lever arm of the locking lever and tilt this away from the outer surface of the side part 61. A release means arranged between the actuation means and the locking lever can thus unlock the locking lever given actuation of the actuation means.

A side view of the cartridge carrier (FIG. 4*a*) from the left is shown in FIG. 4*b*. The button 41 of the actuator 4 projects upwardly beyond the wall 43 because the compression spring 44 acts on the shorter lever arm 422 of the actuation lever that can be tilted on the rotation axis 40. The compression spring 44 is plugged onto the stop block 4221. The rotation axis 40 travels through the rotation pegs 4321, 4232 of the actuation lever. The rotation pegs 4321, 4232 of the actuation lever are mounted such that they can move in rotation in the bearing holes of the mount 431, 432. Given a pressing (not shown) of the trigger finger 411 onto the release trigger surface 6121161 at the end of the short lever arm 612112 of the locking lever, the locking lever unlocks the ink cartridge 5 and will release the ejection mechanism.

Figure 4C:
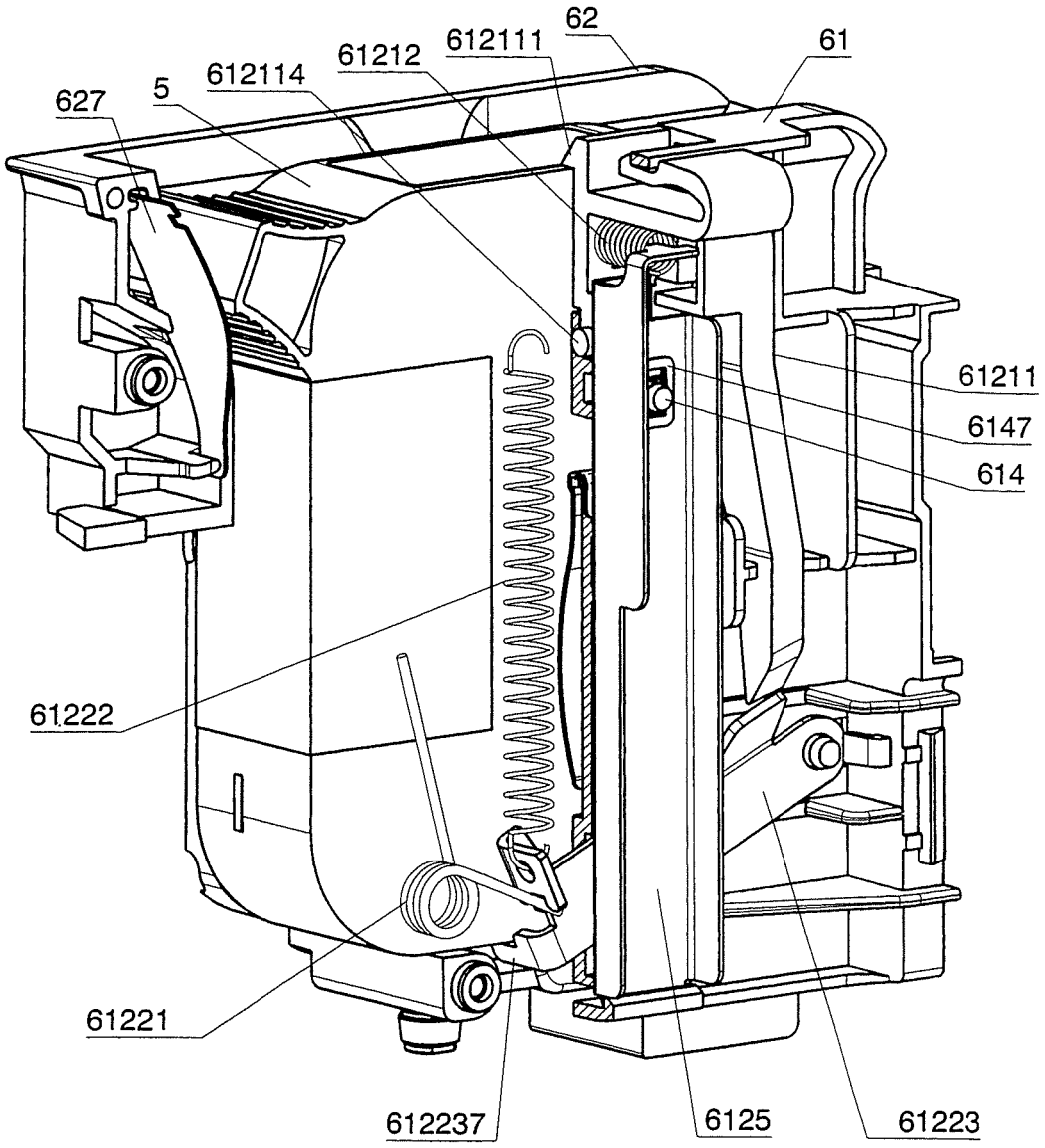
FIG. 4*c* is a perspective view of parts of the cartridge carrier (FIG. 4*b*) with the inserted ink cartridge as seen from the connection side, from the top rear.

A perspective presentation of portions of the cartridge carrier (FIG. 4*b*) with inserted ink cartridge 5 with a view of the connection side from the top rear takes place in FIG. 4*c*. An ink cartridge 5 is inserted between the two side parts 61, 62, the narrow top side and narrow back side of which ink cartridge 5 transition in a known manner into a grip element, wherein the ink cartridge 5 is pressed by the leaf springs 527 on the back side of the cartridge carrier against the inner wall (shown in FIG. 2), and thus onto the contacts of a contacting and control electronics module (the manner is not shown), which contacts are mounted on the front side of the cartridge carrier. The wall (depicted in section) of the side part 61 shows the u-shaped plate 6125 arranged on the connection side of the side part 61, which u-shaped plate 6125 is attached to the attachment peg 614 with a spring nut 6141. The compression spring 61212 and a rotation peg of the locking lever 61211 are held in position with the plate 6125 so that the projection 612111 is pushed in the direction of the ink cartridge 5 and locks this. While in this position, a narrow intervening space from the outer top side of the side wall is maintained with the plate 6125, in which narrow intervening space the lifting plate 61223 can be moved. In the shown locked state, its ink cartridge lifting finger 612237 is placed below the ink cartridge 5, so the torsion spring 61221 is tightened. Since not only one leg end but also the tension spring 61222 is engaged with the lever arm end of the lifting plate 61223, both springs are maximally tensioned. Only when the projection 612111 no longer locks the ink cartridge 5 can all three springs relax.

Figure 5A:
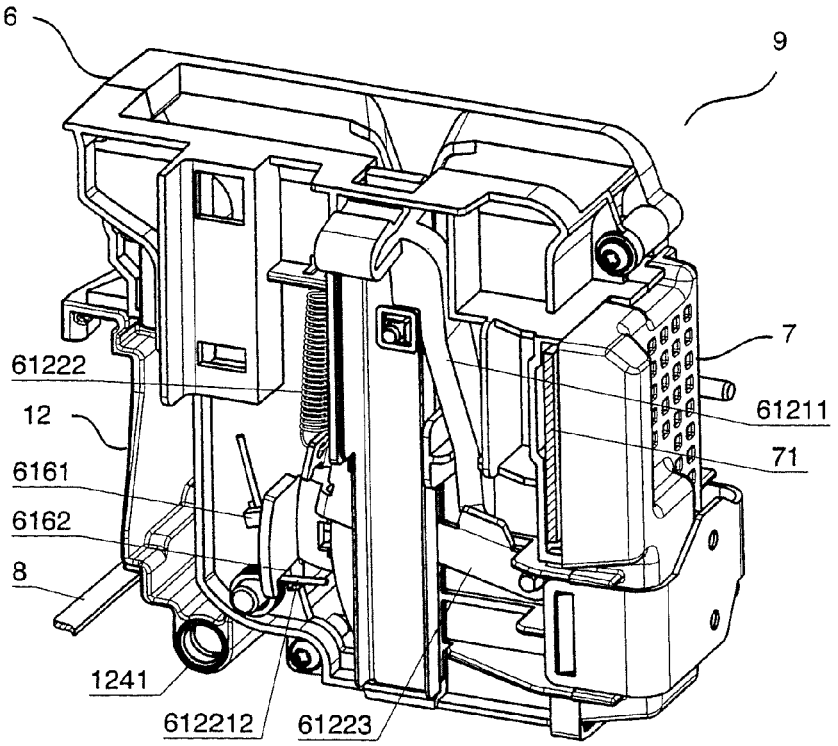
FIG. 5*a* is a perspective view of the completely installed print carriage from the front top left, without an ink cartridge and with an installed sled.

FIG. 5*a* shows a perspective presentation of a completely installed print carriage from the front upper left, without ink cartridge and with mounted sled. The print carriage 9 has the installed cartridge carrier 6 and a laterally mounted contacting and control electronics module 7 with a ribbon cable 71, which is directed out of the completely installed print carriage on the left side (connection side). The sled 12 also extends with one part behind the installed cartridge carrier, wherein a toothed belt 8 and a bearing sleeve 1241 are attached on the left to the aforementioned part and a bearing sleeve 1242 (hidden) is attached on the right to the sled box and are provided for sliding on a guide rod (not shown). The torsion spring 61221 adjacent to the bearing sleeve 1241 has legs 612211, 612212 that rest on the stops 6161, 6162. Only the tension spring 61222 still acts on the lever arm of the lifting plate, wherein the lifting plate acts on the long lever arm of the locking lever which is drawn tilted into an unlocked position and keeps the access to the cavity open.

Figure 5B:
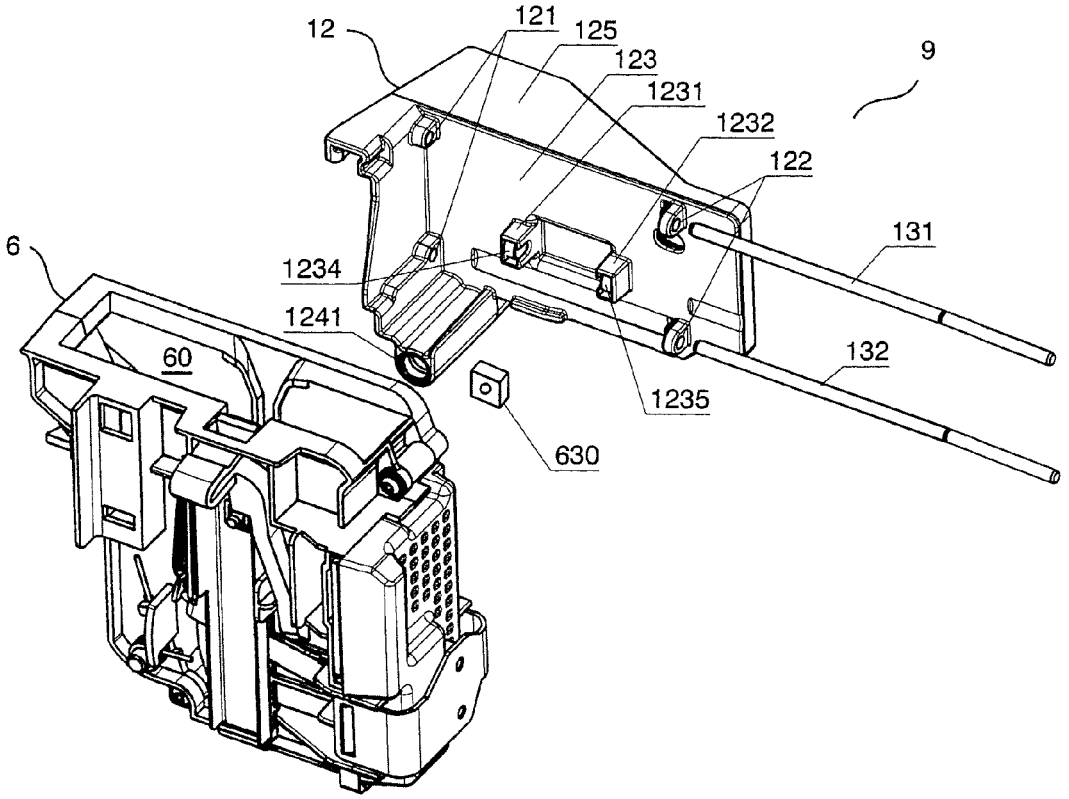
FIG. 5*b* is an exploded view of the print carriage from the top front left, with a completely installed cartridge carrier (FIG. 3*a*), without an ink cartridge and with uninstalled sled.

FIG. 5*b* shows an exploded presentation of the print carriage 9 from the front top left, with completely installed cartridge carrier 6 that—as in FIG. 3*a*—was drawn without ink cartridge and with uninstalled sled 12. The sled 12 can by mounted by two bearing axles 131, 132 on the cartridge carrier 6, wherein the bearing axles 131, 132 are arranged in slide bearings (not shown) molded on the sled side of the cartridge carrier. Two interference fits 121 are molded on the upper and lower edge of the inner side of a rear wall of the sled 12, and two bearing holes are molded on the upper and lower edge of the inner side of the sled 12, near the front part of the sled box 125, into which holes the ends of the slide rods are pressed upon installation on the cartridge carrier 6. Due to the slide bearings, the cartridge carrier 6 is arranged so as to be displaceable relative to the sled and transversal to the movement direction of the print carriage. With an ink cartridge inserted into the contrast agent 60, its print head can thus also be transversally displayed so that the print head can also print image points in a second track in addition to the printing in a first track. The position in the respective track is maintained by the print head in a first or second track via the magnetic force of two permanent magnets 1234 and 1235 which are attached with a predetermined track spacing at two mounts 1231, 1232 molded on the sled inner wall 123. A soft iron part 630 can be mounted (in a manner not shown) on the outside 624 of the cartridge carrier 6 and, in the mounted state, interacts with the permanent magnets, wherein the magnetic force acts on the soft iron part in a known manner so that the respective track is securely maintained. The first bearing sleeve 1241 for the guide rod (not shown) is attached under the attachment part 124 (FIG. 3*b*), to the left next to a sled box 125. The second bearing sleeve 1242 for the guide rod is attached (the manner is not shown) to the right below the sled, covered by the sled box 125.

Figure 6:
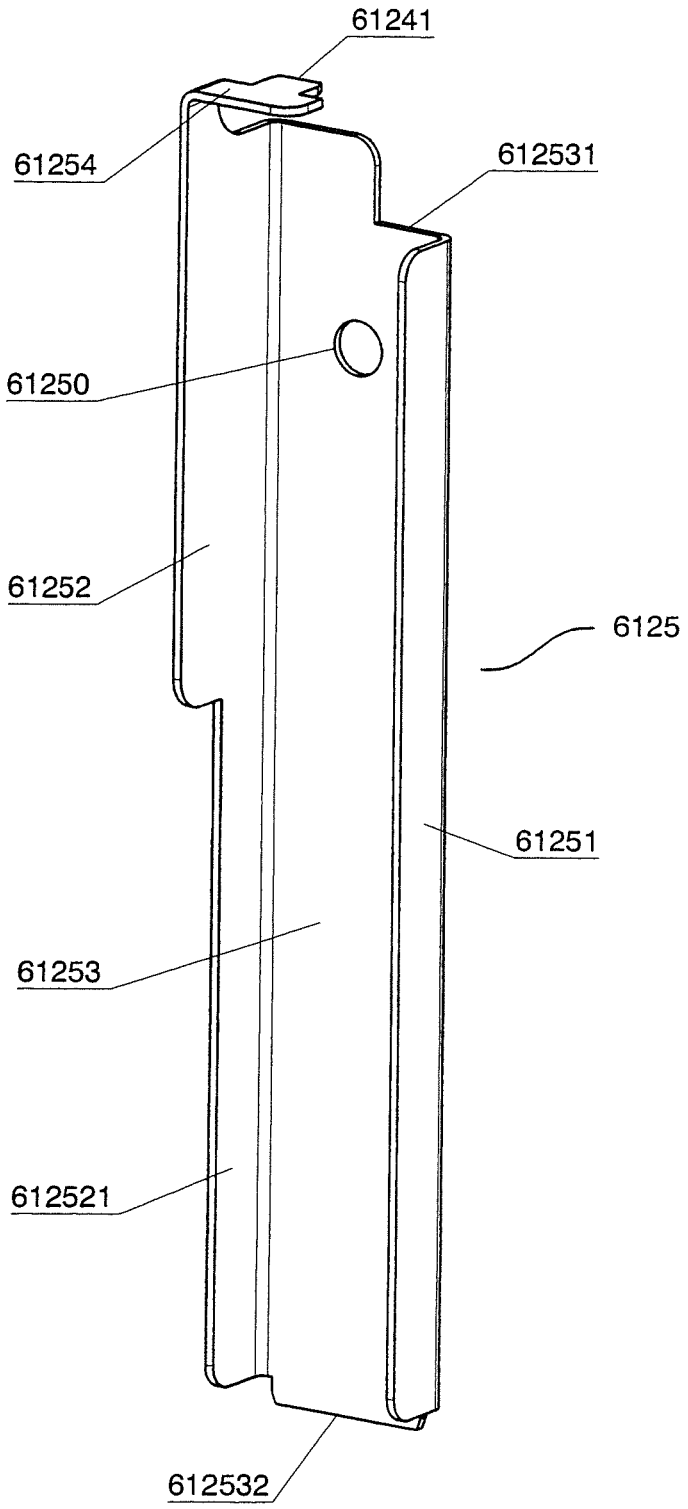
FIG. 6 is a perspective view of the u-shaped plate.

FIG. 6 shows a perspective presentation of the u-shaped plate 6125 that has a narrow side part 61251, a wide side part 61252 and a hole 61250 in a counter-support surface 61253. At the one end of the u-shaped plate, a recess 612531 is provided in the counter-support surface 61253 and an angle piece 61254, wherein a counter-bearing point 612541 is fashioned at the end of the angle piece. A narrow side sub-piece 612521 adjoining the wide side part 61252 extends up to the other end of the u-shaped plate. At the other end of the u-shaped plate, an insertion surface is fashioned in the counter-support surface 61253. The u-shaped plate is installed with the hole 61250 on a bearing peg 613 (FIG. 2).

Figure 7B:
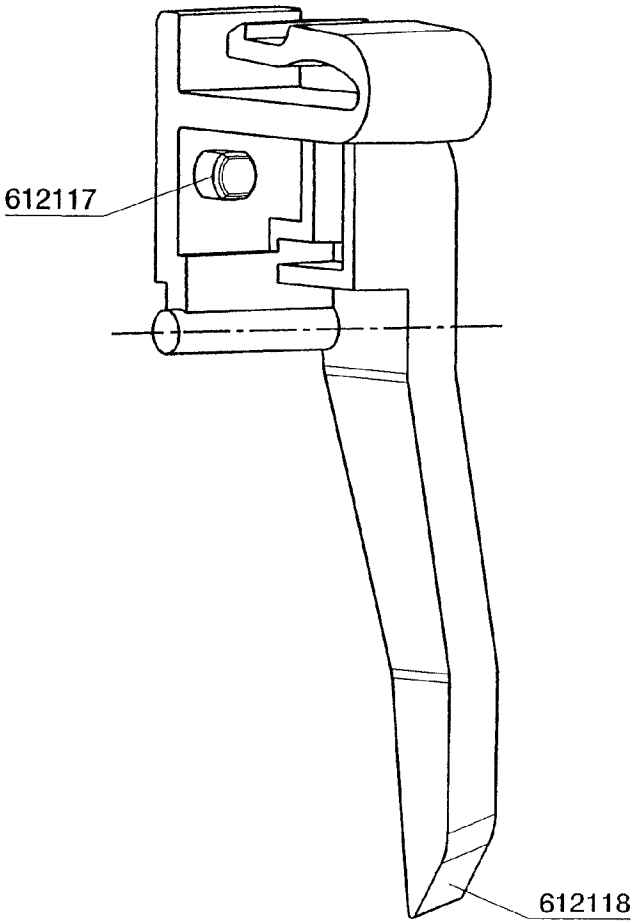
FIG. 7*a, b* are perspective views of the locking lever.
Figure 7A:
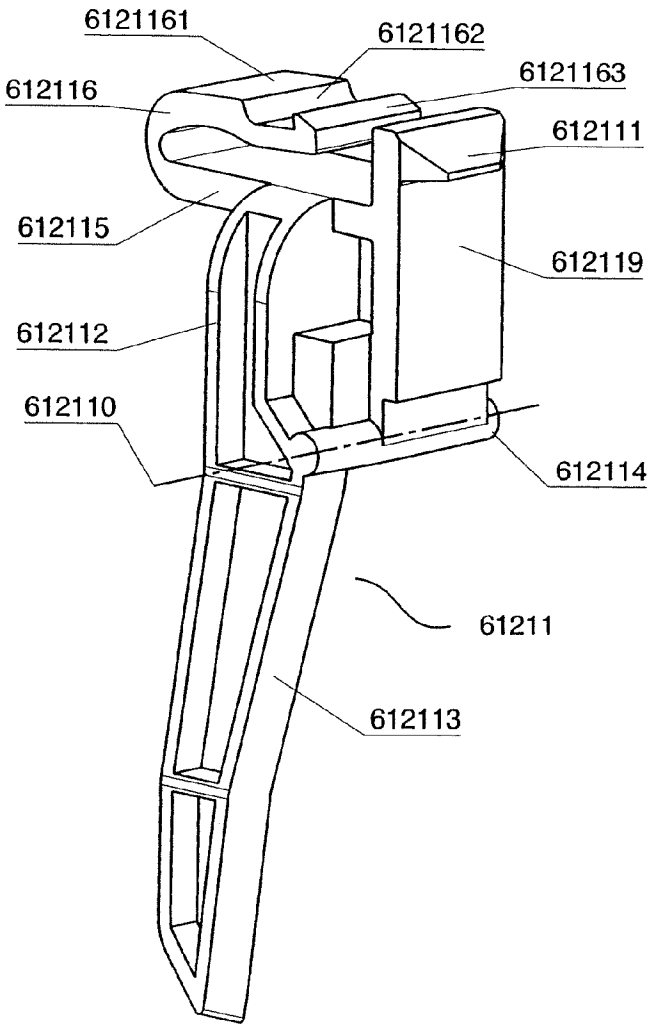

FIGS. 7*a* and 7*b* show perspective presentations of the locking lever 61211. The short lever arm 612112 bears a first connecting piece 612115 on the short lever arm end between a projection 612111 and a resiliently elastic hook support 612116. A second connecting piece 612119 is arranged between a bearing peg 612114 and the projection 612111. The hook support 612116 has a release trigger surface 6121161, notch 6121161 and a snap-in hook 6121163. A bearing peg 612117 for the compression spring is molded on the second connecting piece 612119, under the first connecting piece, wherein the bearing peg 612117 extends in the direction of the hook support 612116, and wherein the second connecting piece 612119 is fashioned as a rectangular shaped piece in the direction towards the cavity, which rectangular shaped piece is adapted to the length L of the opening 610. The long lever arm 612113 bears the control contour 612118 at the lever arm end. The locking lever is fashioned so that it can be tilted around the rotation axis 612110 and is equipped with bearing pegs 612114 on both sides.

Figure 8A:
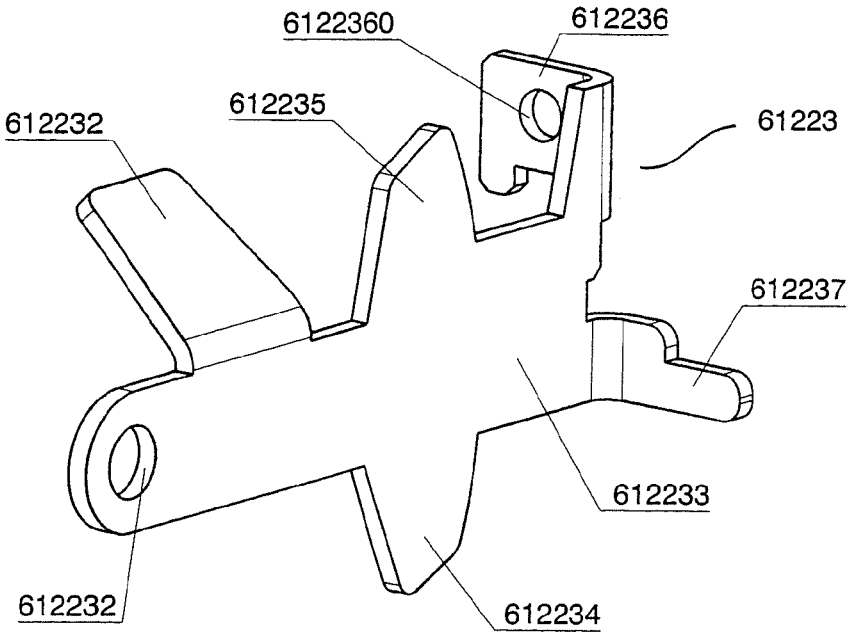
FIG. 8*a, b* are perspective views of the lifting plate.
Figure 8B:
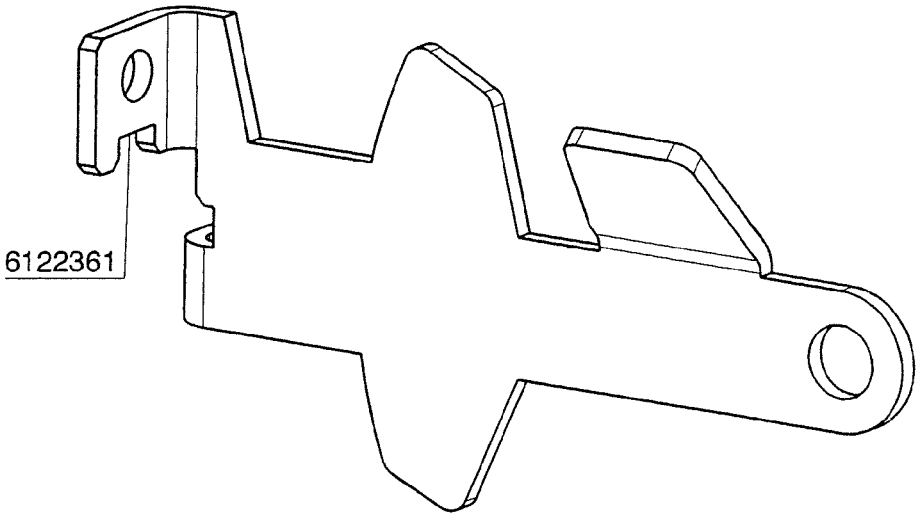

FIGS. 8*a* and 8*b* show perspective presentations of the lifting plate 61223. The lifting plate 61223 has a bearing hole 612231 at the one end, a drive lug 612232 and two support fins 612234, 612235 that stick out laterally at the lever arm 612233, as well as an angled piece 612236 sticking out on one side of the end of the lever arm, which angled piece 612236 is bent upward at a right angle and is provided with a spring suspension hole 6122360 in the middle of the angle piece and with a recess 6122361 that extends laterally on the angle piece and whose opening faces towards the other side of the end of the lever arm. On the other side of the end of the lever arm, a cartridge lifting finger 612237 is bent towards the back side of the lifting plate. The rotation axis 612230 of the lifting plate 61223 travels orthogonal to the rotation axis 612110 of the locking lever 61211 (FIG. 3*a*).

Figure 9:
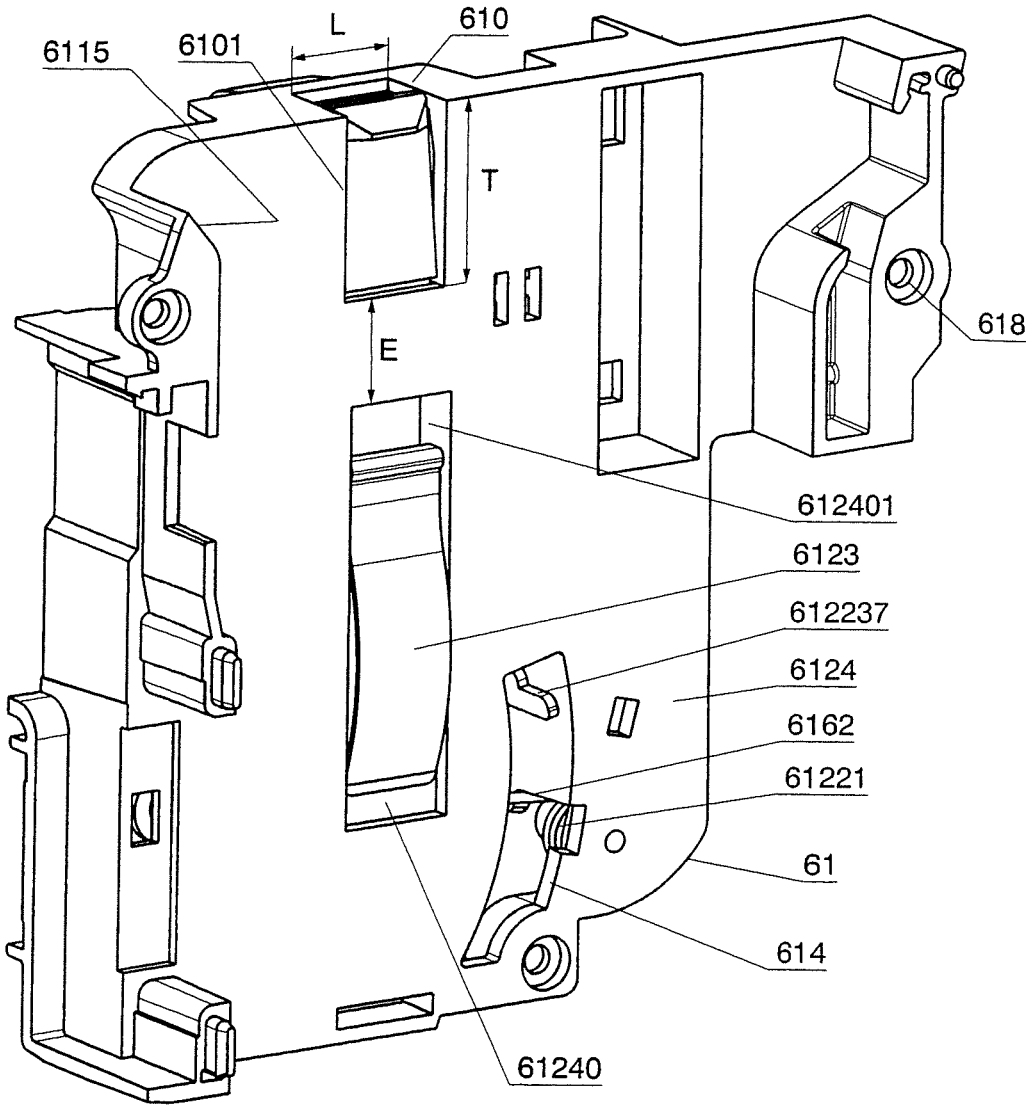
FIG. 9 is a perspective view of the inner wall of a side part 61 of the connection side of the cartridge carrier.

FIG. 9 shows a perspective presentation of the inner wall of a side part 61 of the connection side of the cartridge carrier. From the opening 610, an additional window-shaped opening 6101 of the same length L extends downward into the cavity to a depth T that corresponds to approximately the length of the additional bay, wherein the opening 6101 leads into the additional bay (see FIG. 2). A rectangular depression 61240 in the lateral inner wall 6124 of the left-side part 61 is arranged at a distance E under the opening 6101. The rectangular depression 61240 has a rectangular opening 612401 in the upper part thereof. The rectangular opening 612401 likewise leads into the additional bay, which is provided for the locking lever. A leaf spring 6123 extends downward from the rectangular opening 612401 into the rectangular depression 61240 and is supported on a (hidden) floor surface of said rectangular depression 61240. The leaf spring 6123 is provided for lateral alignment of the ink cartridge on the inner wall 623 of the side part 62 (see FIG. 2). A curved opening

612402 is provided in the lateral inner wall 6124 of the left-side part 61 for the cartridge lifting finger 612237. The curved opening 612402 is situated in a circle segment around the rotation axis 612230 (see FIG. 3*a*) in the region between the hole 619 on the underside of the side part 61 (wherein the hole is provided for the installation of the cartridge carrier), and the aforementioned depression 61240, at the back side of the side part 61.

A stop 6162 for the other leg of the torsion spring 61221 is molded on the inner surface of the side part 61 (which arises from FIG. 2), wherein the stop is arranged on the edge of the curve opening 612402 that is situated closer to the back side of the side part 61; and opposite the end of the rectangular depression 61240. The hole 618 on the back side of the side part 61 serves for installation of the cartridge carrier via an attachment element (see FIG. 2).

The printing apparatus is designed for a right-handed person, wherein the side part on the connection side of the cartridge carrier 6 is the left-side part. Alternatively, it can be provided that the printing apparatus is designed for a left-handed person, wherein the side part on the connection side of the cartridge carrier 6 is the right-side part. The arrangement of the parts of the locking-and-ejection mechanism in principle occurs exactly the same, only laterally reversed. The same applies to the actuator 4.

Although a specific embodiment (namely a button 41 as the actuator 4) is discussed in the present example, a different embodiment is not excluded from the scope of the invention.

Although modifications and changes may be suggested by those skilled in the art, it is the intention of the inventor to embody within the patent warranted hereon all changes and modifications as reasonably and properly come within the scope of his contribution to the art.

We claim as our invention:

1. Printing apparatus comprising a movable cartridge carrier and with a locking-and-ejection mechanism, wherein the cartridge carrier has a cavity for insertion of an ink cartridge in an interior of the cavity, said locking-and-ejection mechanism being attached to a side part of said cartridge carrier at an exterior of said cavity; the locking-and-ejection mechanism comprising a locking mechanism with a locking lever biased with a spring force by a first spring, said locking lever being tiltable around a rotation axis that is situated on said outside of the side part; the locking-and-ejection mechanism comprising an ejection mechanism with a lifting plate biased with a spring force at least by a second spring, said lifting plate being arranged so as to rotate on the outside of the side part around a rotation axis of the lifting plate that is stationary on the outside of the side part; the locking lever comprising a first locking mechanism and a second locking mechanism, said first locking mechanism locking said ink cartridge in said cavity and said second locking mechanism locking said first mechanism when said ink cartridge is in said cavity, and a manually-operable actuation button, said locking lever permitting manual actuation of said actuation button only when said cartridge carrier is in a predetermined position and, when manually actuated, said actuation button actuating said second locking mechanism to unlock said first locking mechanism and cause ejection of said ink cartridge from said cavity, and said lifting plate being rotatable to engage the locking lever upon ejection of the ink cartridge from the cavity and thereby hold the locking lever in a position that keeps said first and second locking mechanisms in the unlocked position after an ejection of an ink cartridge.

2. Printing apparatus according to claim 1, wherein the locking lever has a first locking mechanism projection molded on a short lever arm, a bearing peg and a long lever arm; wherein a connecting piece with a molded elastic hook support is provided on the end of the short lever arm, and the hook support has a release trigger surface and a snap-in hook as a second locking means at the end of a notch, which notch is arranged following the release trigger surface notch; wherein a bearing peg for a compression spring as a first spring is molded on the end of the short lever arm, under the connecting piece; and wherein a control contour is molded on the end of the long lever arm.

3. Printing apparatus according to claim 2, wherein the actuation button is molded on a lever arm end of a long lever arm of an actuation lever, and a lower stop is molded on the other lever arm end of a short lever arm, and rotation pegs of the actuation lever are molded on the connecting surface between the long and short lever arms, and a wall is provided below the first level of the upper housing part, which wall has mounts for the actuation lever into which bearing holes are worked, as well as the one compression spring between the wall and a peg onto which it is placed, wherein the peg forms the lower stop of the actuation lever; and an upper stop is fashioned on the end of the longer lever arm of the actuation lever.

4. Printing apparatus according to claim 3, wherein the distance D is provided between the release trigger surface of the hook support and a tip of the trigger finger, and a release travel F for the tip of the trigger finger is provided; wherein the release travel F corresponds to a sum of distance D, the vertical travel H of the snap-in hook and a safety tolerance S.

5. Printing apparatus according to claim 1, wherein the ejection mechanism has a two-stage spring system with a torsion spring and a tension spring that act on an end of the lever arm of the lifting plate; wherein the lifting plate is furnished with a bearing hole for a bearing peg and the rotation axis travels through the bearing peg; wherein the lifting plate has a drive lug, support fins in the middle and an angle piece, and a cartridge lifting finger at the end of the lever arm; wherein a spring suspension hole is provided in the angle piece and a recess is provided in the angle piece of the lifting plate.

6. Printing apparatus according to claim 1, wherein the locking-and-ejection mechanism has a u-shaped plate with a hole in a counter-support surface, with a narrow side part, with a wide side part and with a narrow side sub-part following this, as well as with an angle piece at the one end of the u-shaped plate; wherein a counter-bearing point for the compression spring is fashioned at the end of the angle piece; and wherein the u-shaped plate is installed with the hole on a bearing peg.

7. Printing apparatus according to claim 1, wherein the outside of a side part is the connection side for a ribbon cable.

8. Printing apparatus according to claim 1, wherein the outside of the respective other side part is the sled side on which a sled is mounted.

9. Printing apparatus according to claim 1, wherein the printing apparatus is designed for right-handed people, wherein the side part on the connection side of the cartridge carrier is the left-side part.

10. Printing apparatus according to claim 1, wherein the printing apparatus is designed for left-handed people, wherein the side part on the connection side of the cartridge carrier is the right-side part.

* * * * *